United States Patent [19]

Dillon et al.

[11] Patent Number: 4,576,848

[45] Date of Patent: Mar. 18, 1986

[54] PILE FABRICS AS WOVEN TERRY FABRICS WITH DIAGONAL GROOVES OF CUT PILE

[75] Inventors: Larry W. Dillon, Ridgeway; Robert L. Jamerson, Collinsville; Thomas M. Padgett, Martinsville, all of Va.

[73] Assignee: Fieldcrest Mills, Inc., Eden, N.C.

[21] Appl. No.: 747,975

[22] Filed: Jun. 24, 1985

[51] Int. Cl.[4] ..... B32B 3/00

[52] U.S. Cl. ..... 428/89; 428/92; 428/95

[58] Field of Search ..... 428/89, 92, 95

[56] References Cited

U.S. PATENT DOCUMENTS

| | | | |
|---|---|---|---|
| 1,433,474 | 10/1922 | Poetzsch | 26/16 |
| 1,659,535 | 2/1928 | Richardson | 26/16 |
| 1,708,763 | 8/1927 | Huss et al. | 26/16 |
| 2,977,660 | 4/1961 | Gebert et al. | 26/16 |
| 3,566,492 | 3/1971 | Handley et al. | 26/16 |
| 3,666,608 | 5/1972 | Mattes | 428/89 |
| 3,669,818 | 6/1972 | Stark | 428/89 |
| 3,758,924 | 9/1973 | Holm | 26/16 |
| 3,785,016 | 1/1974 | Hergert | 26/2 R |

FOREIGN PATENT DOCUMENTS

| | | | |
|---|---|---|---|
| 5659 | of 1882 | United Kingdom | 26/16 |
| 8859 | of 1914 | United Kingdom | 26/16 |

*Primary Examiner*—Marion C. McCamish

*Attorney, Agent, or Firm*—Bell, Seltzer, Park & Gibson

[57] ABSTRACT

A pile fabric such as a woven terry pile fabric having diagonal grooves of cut pile formed therein on at least one face of the fabric and extending generally widthwise of the fabric with the cut pile within the grooves being of variable height imparting a sculptured pattern appearance to the fabric. Woven terry towels made in accordance with the invention may have one side of the towel sheared to form a cut pile face with or without the diagonal grooves of cut pile present therein. The other side of the towel may be loop terry pile with or without diagonal grooves of cut pile formed therein. Further variations may include jacquard patterns formed in the pile fabric with the diagonal grooves of cut pile intersecting or extending across the jacquard pattern to impart a sculptured pattern appearance superimposed on the jacquard pattern. Still further variations may include segmental grooves and intersecting grooves to present unusual pattern effects.

17 Claims, 15 Drawing Figures

PILE FABRICS AS WOVEN TERRY FABRICS WITH DIAGONAL GROOVES OF CUT PILE

This invention relates to pile fabrics formed by any conventional technique such as terry weaving, knitting, tufting, carpet weaving, needle punching (non-woven pile fabrics), or any other suitable conventional technique. In the preferred form, the invention is embodied in a woven terry pile fabric, particularly terry towels.

As is well known in current technology for manufacturing terry towels, texture of the towel is achieved in weaving by one of several techniques such as by weaving contrasting terry pile loops against dropped or ground-engaging terry loops, or by employment of dual let off gears on the loom to vary the height of the pile in the fabric. Also, it is known to use various combinations of fiber content and finishing processes to obtain various high/low effects in a terry fabric for enhancement of the visual appearance of the fabric.

With the foregoing in mind, one of the purposes of this invention is to introduce novel fabric effects in a wide variety of pile fabrics such as terry pile fabrics, particularly terry towels, for enhanced texture to the terry pile surface of the fabric. Briefly stated, this is accomplished by providing diagonal grooves of cut pile in the fabric, on at least one face thereof, with the grooves extending generally widthwise of the fabric with the cut pile within the grooves being of variable height imparting a sculptured pattern appearance to the fabric.

Woven terry towels made in accordance with this invention may have one side of the towel sheared to form a velour texture to the sheared pile face with or without diagonal grooves of cut pile present therein. Likewise the other side of the towel may be looped terry pile with or without diagonal grooves of cut pile formed therein.

Further variations of the invention may include jacquard patterns formed in the pile fabric with the diagonal grooves of cut pile intersecting or extending across the jacquard pattern to impart a sculptured pattern appearance superimposed on the jacquard pattern. Still further variations may include segmental grooves and intersecting grooves to present unusual pattern effects, all as will become more apparent from the detailed specification and accompanying drawings.

Some of the objects and advantages of the present invention having been stated, others will appear as the description proceeds, when considered in conjunction with the accompanying drawings, in which—

Figure 13:
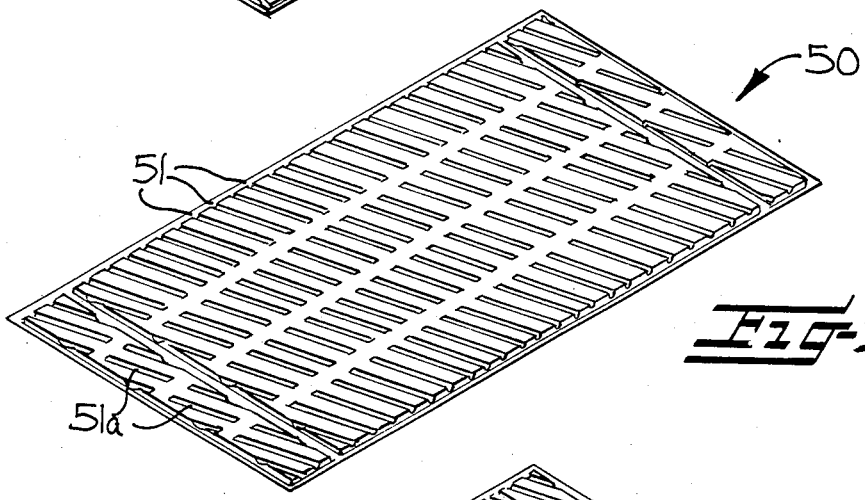
FIG. 13 is another schematically illustrated embodiment of the invention wherein the diagonal grooves are of a segmental nature and arranged in spaced relation widthwise across at least one side of the fabric.
Figure 14:
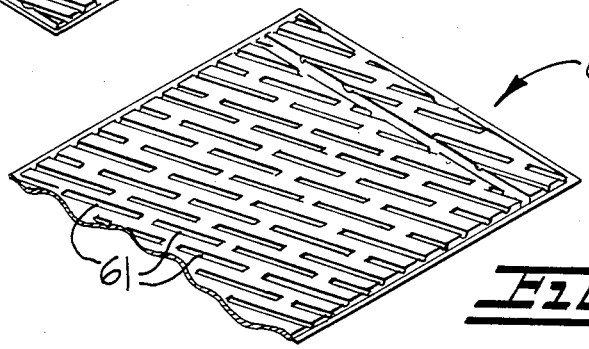
Figure 15:
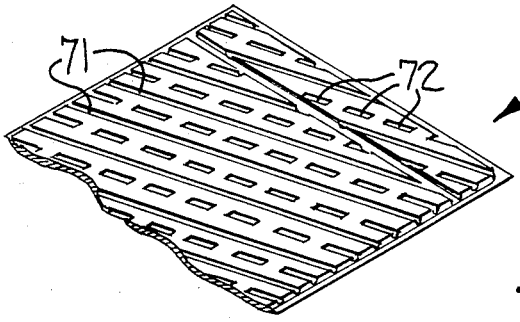

FIG. 14 is a further schematically illustrated embodiment of the invention wherein the segmental grooves are staggered relative to each other instead of being arranged in rows as in FIG. 13; and FIG. 15 is another schematic illustration of a still further embodiment of the invention wherein the diagonal grooves are shown as being a combination of continuous diagonal grooves alternating with lines of segmental diagonal grooves extending across at least one face of the fabric.

Figure 1:
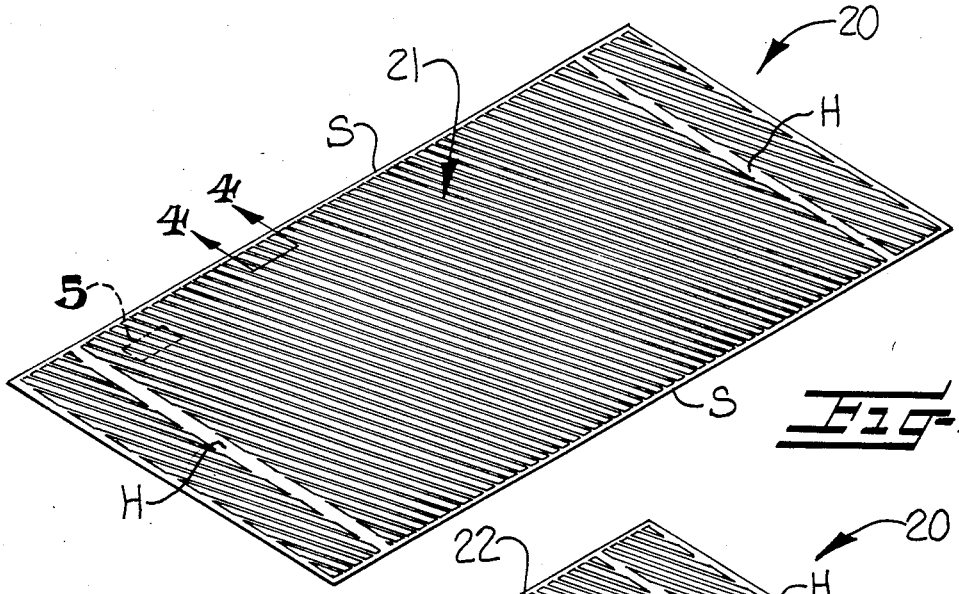
FIG. 1 is a schematic view of one form of the invention as incorporated in a woven terry towel.
Figure 2:
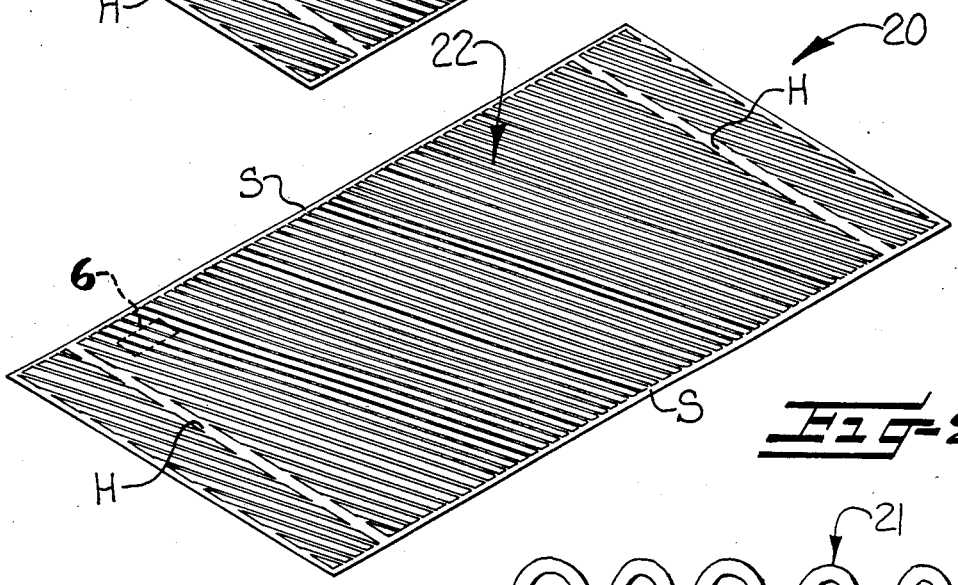
FIG. 2 is another schematic view showing the opposite side of the towel fabric of FIG. 1.
Figure 3:
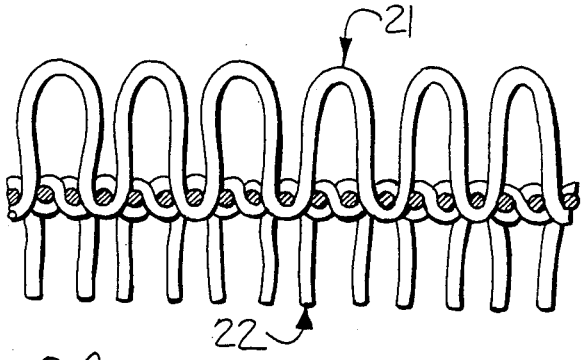
FIG. 3 is a schematic view illustrating a conventional 3 pick terry fabric weave for forming the terry towel fabric of FIGS. 1 and 2.
Figure 4:
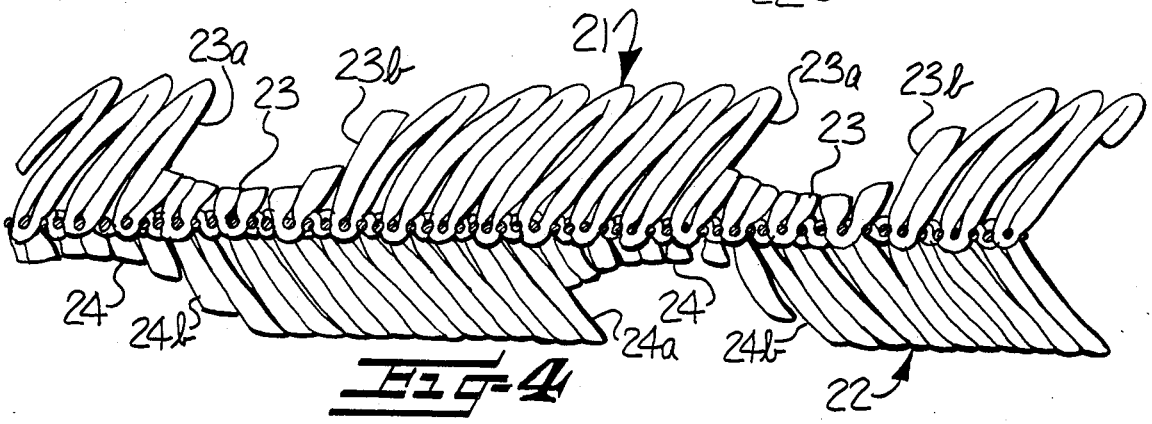
FIG. 4 is a schematic greatly enlarged cross-sectional view taken along line 4—4 of FIG. 1 and transversely of the grooves and illustrating that the cut pile within the grooves is of a variable height for aiding in imparting a sculptured pattern appearance to the towel.
Figure 5:
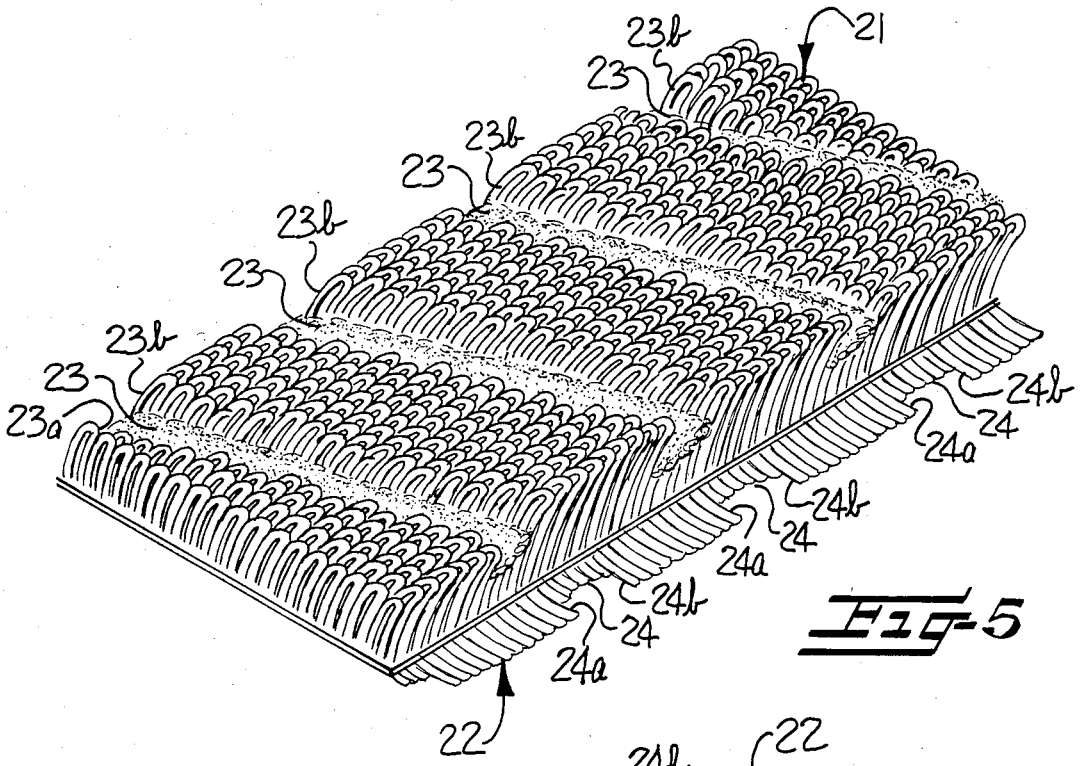
FIG. 5 is a greatly enlarged top perspective view of the area 5 of FIG. 1 showing loop terry pile with cut grooves.
Figure 6:
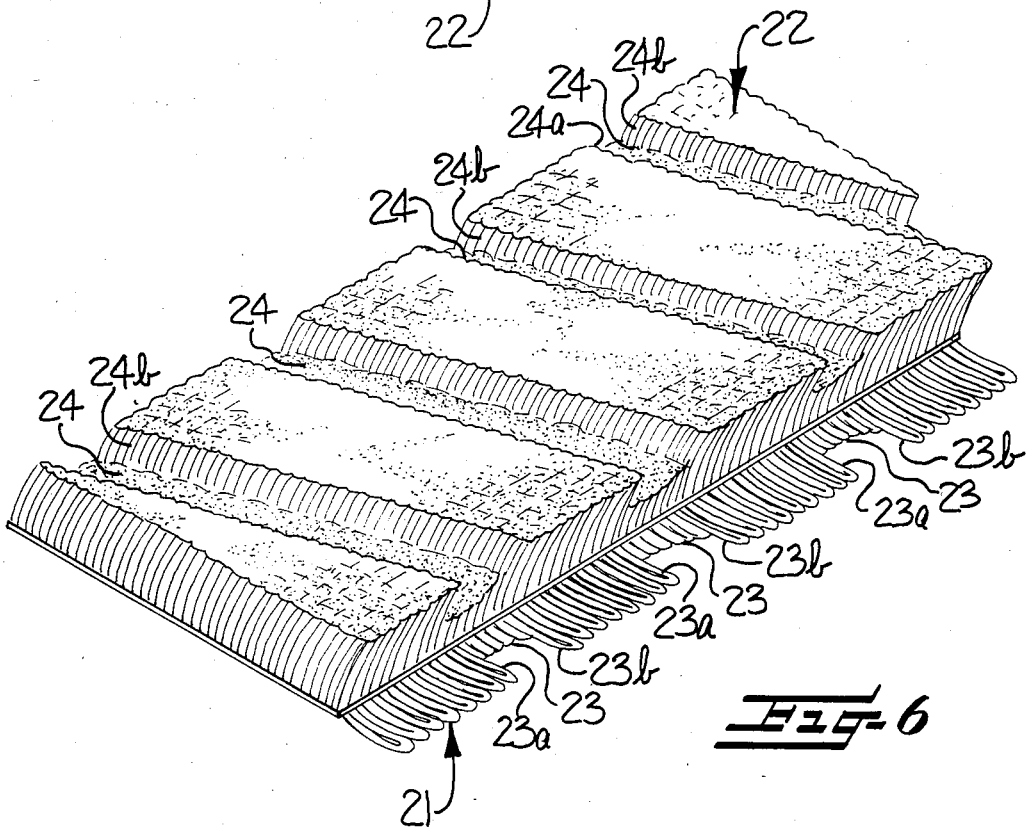
FIG. 6 is a similar view to FIG. 5 but taken from area 6 of FIG. 2 to show the opposite side of the towel as being sheared to give a velour effect but also having cut grooves therein.
Figure 7:
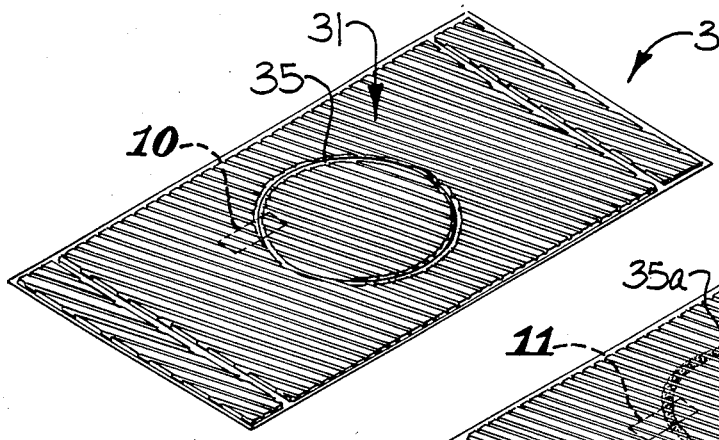
FIG. 7 is a schematic perspective view of another embodiment of the invention wherein a woven jacquard pattern shown in relief is illustrated as being incorporated within the face of the towel.

Referring now to the drawings and particularly FIGS. 1–6, wherein the first embodiment of the invention is illustrated, reference numeral 20 broadly indicates a woven terry towel having opposing side selvages S and conventional header areas H positioned adjacent opposite ends of the towel. The upper face or side 21 of the fabric illustrated in FIGS. 1, 4 and 5 is of loop terry construction with the opposite face or side 22 of the towel as best seen in FIGS. 2, 4 and 6 being sheared terry to present a velour appearance to this side of the towel. On both sides or faces 21, 22 of the towel are provided respective diagonal grooves of cut pile 23, 24.

It will be noted that the diagonal grooves 23, 24 of cut pile formed on the respective faces of the fabric are uniformly spaced apart and parallel and extend diagonally of and generally widthwise of the fabric from adjacent one selvage S to the other selvage. It will further be noted that the cut pile within the grooves as best seen in FIG. 4 is of variable height for imparting a sculptured pattern appearance to the fabric.

It will further be noted in FIG. 4 that each of the diagonal grooves 23, 24 has a substantially vertical side 23*a*, 24*a* and a sloping opposite side 23*b*, 24*b* of variable height of pile and wherein the sloping side 23*b*, 24*b* of the grooves is positioned downstream of the direction of pile lie. As is well known, "pile lie" is the direction that the pile of the fabric generally leans or inclines. It will further be noted upon viewing FIG. 4 that the uncut terry pile loops 21 of the upper face of the fabric defining the vertical side 23*a* of the diagonal grooves 23, overlie and somewhat shield from view the adjacent underlying relatively short cut pile in the diagonal grooves 23. Similarly, with respect to the grooves 24 in the lower face of the fabric, the cut terry pile 22 defining the vertical side 24*a* of the diagonal grooves 24 overlies and somewhat shields from view the adjacent underlying relatively short cut pile in the grooves 24. This arrangement contributes materially to the appearance of the pile in the groove being of a darker color than the adjacent terry pile. Further, as is well known to those versed in textiles, the color shading of the cut pile in the grooves is also darker since the cut pile forming the groove reflects less light than uncut pile. This further serves for emphasizing the sculptured appearance of the fabric and lends prominence to the high low pile effect created by the cut diagonal grooves.

FIG. 3 illustrates a conventional three pick woven terry fabric wherein for each three picks of the fabric one loop is formed. As illustrated, the upper surface of the terry towel is a looped pile while the lower surface is sheared terry for providing the velour effect therein.

Figure 8:
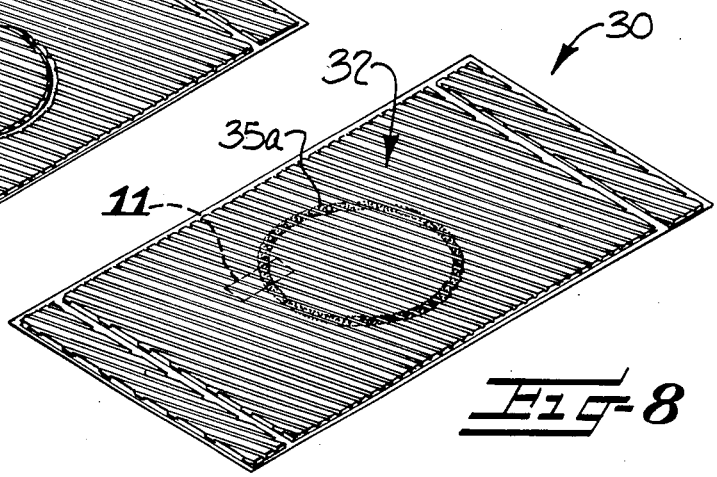
FIG. 8 is a view similar to FIG. 7 but looking at the opposite side of the towel from FIG. 7.
Figure 9:
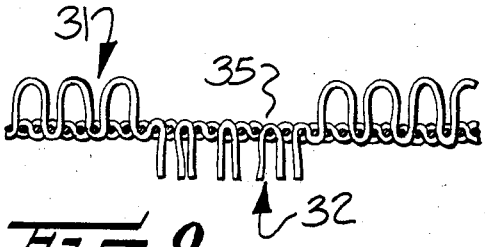
FIG. 9 is an enlarged schematic view illustrating the conventional manner in which terry pile yarns are woven with the ground yarns for effecting the relief jacquard pattern design of FIGS. 7 and 8.
Figure 10:
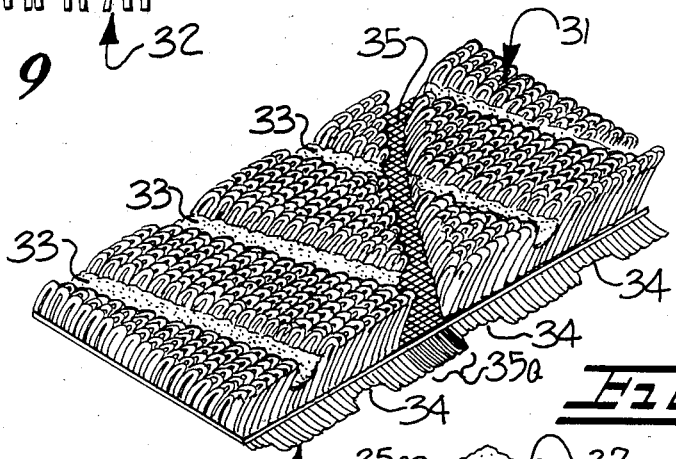
FIG. 10 is a greatly enlarged fragmentary perspective view of the enclosed area 10 of FIG. 7 showing the terry loop side of the towel.
Figure 11:
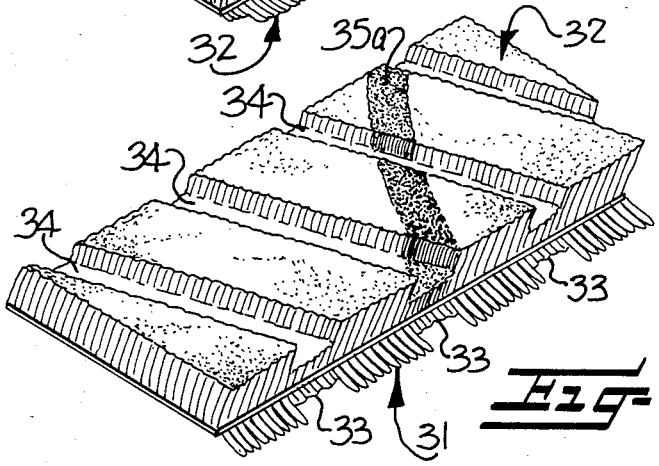
FIG. 11 is a view looking at the enclosed area 11 of FIG. 8 showing the opposite sheared side of the towel.

Referring now to FIGS. 7–11, another embodiment of the invention is illustrated and is identified broadly by numeral 30. As in the first form of the invention, this form of the invention is also illustrated as being incorporated in a woven terry towel. This form of the invention basically differs over the first form in that a jacquard pattern or motif 35 is incorporated therein. As will be noted from viewing FIGS. 7, 9, and 10, the jacquard pattern 35 formed on the upper terry loop side 31 of the fabric presents pattern 35 in relief, i.e. wherein there is an absence of any upstanding terry loops. The opposite side 32 of the towel 30, as shown in FIGS. 8 and 11, exhibits a greater concentration of cut terry loops 35*a* in that area of the fabric wherein the loops that would normally be on the other side have now been concentrated. For a further understanding of this type of conventional terry weaving, FIG. 9 illustrates schematically the manner in which terry yarns are arranged for creating conventional jacquard patterns 35 in relief on terry fabrics. It will be noted that by having a jacquard pattern incorporated in this illustrated embodiment of the invention, that the diagonal grooves 33, 34 extend across the jacquard pattern 35 to impart a sculptured pattern appearance superimposed on the jacquard pattern. This further adds to the uniqueness of the sculptured pattern appearance present on the terry towel.

Figure 12:
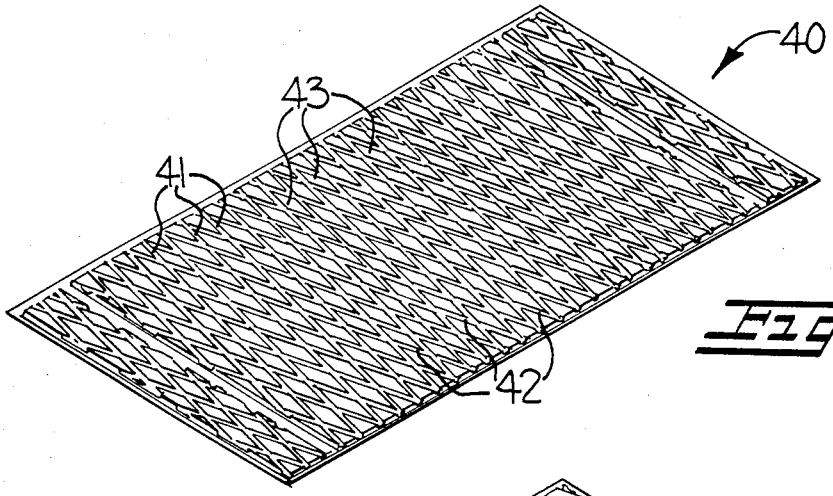
FIG. 12 is a further schematically illustrated embodiment of the invention wherein intersecting diagonal grooves are provided across the fabric on at least one side thereof.

Referring now to FIG. 12, the terry towel 40 schematically illustrated therein is shown as having first and second groups 41, 42 of diagonal grooves of cut pile with the diagonal grooves of the first group 41 intersecting the diagonal grooves of the second group 42 to define diamond shaped uncut pile areas 43 therebetween. As illustrated, the diagonal grooves 41, 42 extend uninterruptedly diagonally across the terry fabric from adjacent one selvage side edge to adjacent the opposite selvage.

Referring now to a further embodiment of the invention, as illustrated in FIG. 13, and as broadly identified by reference numeral 50, this form of the invention has diagonal grooves 51 formed of relatively short segmental grooves 51*a* instead of continuous diagonal grooves as in the prior embodiments of the invention. As illustrated, the segmental grooves 51*a* are ranged in four rows positioned to extend lengthwise of the fabric.

Referring now to a still further embodiment of the invention, as illustrated in FIG. 14 and identified by reference numeral 60, this form of the invention basically differs over that of FIG. 13 in that the segmental grooves 61 are arranged in staggered relationship instead of in lengthwise rows. A more broken pattern appearance is presented to the fabric by this arrangement.

Referring now to the last illustrated embodiment of the invention, as illustrated in FIG. 15, and identified by reference numeral 70, this embodiment of the invention illustrates a combination of continuous diagonal grooves 71 alternating with lines of segmental grooves 72 and wherein the grooves are parallel to each other. It will be noted that the lines of segmental grooves 72 viewed widthwise of the fabric are arranged in alignment with each other and parallel to the continuous diagonal grooves 71.

It has been determined that the diagonal grooves may best be formed in the fabric by shearing blades of reel type shearers with the fabric being fed into the shearing machine in indefinite length form at a constant feed proportional to the rpm of the cutting edge of the shearer blade. Depth of cut and spacing of diagonal grooves is controlled by suitable adjustments. Fabric after shearing is then cut into product units, such as towels and fabricated with hems, overedging, or embellishments.

It should be apparent from the various embodiments of the invention disclosed and illustrated in the drawings, that a wide variety of unique pile fabrics are provided by the present invention. Further, all of the embodiments of the invention have the common feature of diagonal grooves of cut pile formed in the pile and extending diagonally of and generally widthwise of the fabric and wherein the cut pile within the grooves is of a variable height imparting a unique sculptured pattern appearance to the various fabrics.

It should further be understood that in the drawings and specification a variety of different embodiments of the invention have been illustrated and although specific terms are employed, they are to be used in a generic and descriptive since only and not for purposes of limitation.

That which is claimed:

1. A pile fabric comprising a base fabric, pile extending from at least one face of said base fabric, cut pile formed in said pile and defining diagonal grooves extending diagonally of and generally widthwise of the fabric, and wherein the cut pile within the grooves is of variable height imparting a sculptured pattern appearance to the fabric.

2. A pile fabric according to claim 1 wherein said pile fabric is a terry pile fabric having terry pile formed of plied yarns extending from opposite faces of said base fabric and wherein said diagonal grooves are provided in the terry pile of at least one of said faces.

3. A pile fabric according to claim 1 or 2 wherein at least some of said grooves of cut pile extend uninterruptedly diagonally across the pile fabric from adjacent one side edge thereof to adjacent the opposite side edge thereof.

4. A pile fabric according to claim 1 or 2 wherein at least some of said grooves of cut pile include aligned relatively short segmental grooves extending across the pile fabric.

5. A pile fabric according to claim 1 or 2 wherein at least some of said diagonal grooves of cut pile extend parallel to each other and are uniformly spaced apart from each other.

6. A pile fabric according to claim 1 or 2 wherein the pile has a generally common direction of pile lie extending lengthwise of the fabric, each of said diagonal grooves having a substantially vertical side and a sloping opposite side of variable height of pile imparting a sculptured pattern appearance to the fabric, and wherein the sloping side of each of the diagonal grooves is positioned downstream of the direction of pile lie.

7. A pile fabric according to claim 1 or 2 wherein said diagonal grooves of cut pile comprise first and second groups of diagonal grooves of cut pile with the diagonal grooves of said first group intersecting the diagonal grooves of said second group and defining diamond shaped uncut pile areas therebetween.

8. A pile fabric according to claim 1 or 2 wherein said pile fabric has a jacquard pattern provided in the pile thereon and wherein said diagonal grooves extend across the jacquard pattern to impart a sculptured pattern appearance superimposed on the jacquard pattern.

9. A terry pile fabric comprising a base fabric, terry pile yarns forming terry pile extending from opposite faces of said base fabric, the terry pile on at least one face of the base fabric being entirely cut terry pile, some of said cut pile provided in at least said one of said faces, defining diagonal grooves extending diagonally of and widthwise of the fabric, and each of said diagonal grooves having a substantially vertical side and a sloping opposite side of variable height of pile imparting a sculptured pattern appearance to the terry fabric.

10. A terry fabric according to claim 9 wherein both faces of the base fabric are entirely of cut terry pile.

11. A terry fabric according to claim 9 wherein the terry pile on the opposite face of said base fabric is loop terry pile.

12. A terry fabric according to claim 11 wherein said loop terry side of said base fabric has cut pile portions defining diagonal grooves therein extending diagonally of and generally widthwise of the fabric.

13. A terry pile fabric comprising a base fabric, terry pile yarns forming terry pile extending from opposite faces of said base fabric, the terry pile on one face of the base fabric being entirely loop terry pile, the terry pile on the major portion of the opposite face of the base fabric also being loop terry pile and having a generally common direction of pile lie extending lengthwise of the fabric, the remainder of the terry pile on said opposite face of the fabric being cut terry pile defining diagonal grooves of cut pile, each of said diagonal grooves having a substantially vertical side and a sloping opposite side of variable height of pile imparting a sculptured pattern appearance to the terry fabric, and wherein the sloping side of each of the diagonal grooves is positioned downstream of the direction of pile lie.

14. A terry pile fabric comprising a base fabric, terry pile yarns forming terry pile extending from opposite faces of said base fabric, the terry pile on one face of the base fabric being entirely loop terry pile, the terry pile on the major portion of the opposite face of the base fabric also being loop terry pile having a jacquard pattern provided in the pile, said loop terry pile having a generally common direction of pile lie extending lengthwise of the fabric, the remainder of the terry pile on said opposite face of the fabric being cut terry pile defining diagonal grooves of cut pile extending across the jacquard pattern to impart a sculptured pattern appearance superimposed on the jacquard pattern, each of said diagonal grooves having a substantially vertical side and a sloping opposite side of variable height of pile imparting a sculptured pattern appearance to the terry fabric, and wherein the sloping side of each of the diagonal grooves is positioned downstream of the direction of pile lie.

15. A terry pile fabric comprising a base fabric, terry pile yarns forming terry pile extending from opposite faces of said base fabric, the terry pile on one face of the base fabric being entirely cut terry pile, the terry pile on the major portion of the opposite face of the base fabric being loop terry pile having a jacquard pattern provided in the pile, said loop terry pile having a generally common direction of pile lie extending lengthwise of the fabric, the remainder of the terry pile on the opposite face of the fabric being cut terry pile defining diagonal grooves of cut pile extending across the jacquard pattern to impart a sculptured pattern appearance superimposed on the jacquard pattern, each of said diagonal grooves having a substantially vertical side and a sloping opposite side of variable height of pile, and wherein the sloping side of each of the diagonal grooves is positioned downstream of the direction of the pile lie.

16. A terry pile fabric according to claim 14 or 15 wherein said terry fabric is a woven three pick terry fabric and wherein an absence of terry loops outlines and defines the jacquard pattern motif.

17. A terry pile fabric according to claim 14 or 15 wherein said terry fabric is a woven three pick terry fabric and wherein terry loops of lower height than the terry loops in the jacquard pattern outline and define the jacquard pattern motif.

* * * * *